US009802782B2

(12) United States Patent
Taki et al.

(10) Patent No.: US 9,802,782 B2
(45) Date of Patent: Oct. 31, 2017

(54) SHEET PROCESSING APPARATUS

(71) Applicants: KABUSHIKI KAISHA TOSHIBA, Tokyo (JP); TOSHIBA TEC KABUSHIKI KAISHA, Tokyo (JP)

(72) Inventors: Hiroyuki Taki, Mishima Shizuoka (JP); Yasunobu Terao, Izunokuni Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/159,691

(22) Filed: May 19, 2016

(65) Prior Publication Data

US 2016/0347569 A1 Dec. 1, 2016

(30) Foreign Application Priority Data

May 25, 2015 (JP) ..... 2015-105859

(51) Int. Cl.
*B65H 29/54* (2006.01)
*B65H 37/04* (2006.01)
(Continued)

(52) U.S. Cl.
CPC ..... *B65H 37/04* (2013.01); *B65H 29/145* (2013.01); *B65H 29/52* (2013.01); *B65H 31/26* (2013.01); *B65H 31/3027* (2013.01); *G03G 15/6529* (2013.01); *G03G 15/6538* (2013.01); *G03G 15/6541* (2013.01); *B65H 9/00* (2013.01); *B65H 9/08* (2013.01); *B65H 2301/4212* (2013.01); *B65H 2301/4213* (2013.01); *B65H 2301/4219* (2013.01); *B65H 2301/42194* (2013.01); *B65H 2403/942* (2013.01); *B65H 2404/612* (2013.01); *B65H 2404/693* (2013.01);
(Continued)

(58) Field of Classification Search
CPC .. B65H 2301/42194; B65H 9/00; B65H 9/08; B65H 2301/4219
See application file for complete search history.

(56) References Cited

U.S. PATENT DOCUMENTS 7,665,792 B1 2/2010 Flynn
7,748,704 B2 7/2010 Terao et al.
(Continued)

FOREIGN PATENT DOCUMENTS

JP 2007-084254 A 4/2007

*Primary Examiner* — Howard Sanders
(74) *Attorney, Agent, or Firm* — Patterson & Sheridan, LLP

(57) ABSTRACT

According to an embodiment, a sheet processing apparatus includes a transport unit and a holding unit. The transport unit transports a first sheet to a first position. The transport unit transports a second sheet, which is transported after the first sheet, to a second position displaced to the upstream side of a sheet transport direction relative to the first position. The transport unit transports a third sheet, which is transported after the second sheet, to a third position displaced to the downstream side of the sheet transport direction relative to the second position. In the case where the second sheet is transported to the second position, the holding unit holds the first sheet at the first position. In the case where the third sheet is transported to the third position, the holding unit holds the second sheet at the second position.

8 Claims, 20 Drawing Sheets

(51) Int. Cl.

| | |
|---|---|
| ***G03G 15/00*** | (2006.01) |
| ***B65H 29/14*** | (2006.01) |
| ***B65H 29/52*** | (2006.01) |
| ***B65H 31/26*** | (2006.01) |
| ***B65H 31/30*** | (2006.01) |
| *B65H 9/00* | (2006.01) |
| *B65H 9/08* | (2006.01) |

(52) U.S. Cl.
CPC ... *B65H 2408/121* (2013.01); *G03G 15/6547* (2013.01); *G03G 2215/00827* (2013.01)

(56) References Cited

U.S. PATENT DOCUMENTS

| | | | | |
|---|---|---|---|---|
| 7,896,333 | B2 | 3/2011 | Taki et al. | |
| 8,028,983 | B2 | 10/2011 | Taki et al. | |
| 8,132,804 | B2 | 3/2012 | Taki et al. | |
| 2006/0208411 | A1* | 9/2006 | Saito | B42C 1/12 270/58.07 |
| 2008/0317530 | A1 | 12/2008 | Taki et al. | |
| 2014/0054854 | A1* | 2/2014 | Kushida | B65H 29/22 271/306 |
| 2016/0002001 | A1* | 1/2016 | Kotani | B65H 31/34 270/58.07 |

* cited by examiner

SHEET PROCESSING APPARATUS

CROSS-REFERENCE TO RELATED APPLICATIONS

This application is based upon and claims the benefit of priority from the prior Japanese Patent Application No. 2015-105859, filed on May 25, 2015, the entire contents of which are incorporated herein by reference.

FIELD

An embodiment described here generally relates to a sheet processing apparatus.

BACKGROUND

A post-processing apparatus that performs post-processing on sheets transported from an image-forming apparatus is known. The post-processing apparatus includes a processing tray and a standby tray. In the processing tray, post-processing is performed. The standby tray is provided above the processing tray. During the post-processing performed on sheets in the processing tray, the standby tray temporarily retains subsequent sheets. When the processing tray becomes empty, the standby tray drops the retained sheets toward the processing tray. Incidentally, the post-processing apparatus aligns multiples sheets and then performs stapling processing as one post-processing thereon. In order to accurately perform the stapling processing, it is necessary to improve accuracy of sheet alignment as a preceding process. However, there has been a case where the accuracy of sheet alignment is difficult to sufficiently increase depending on a transport state of the sheets.

DETAILED DESCRIPTION

Figure 1:
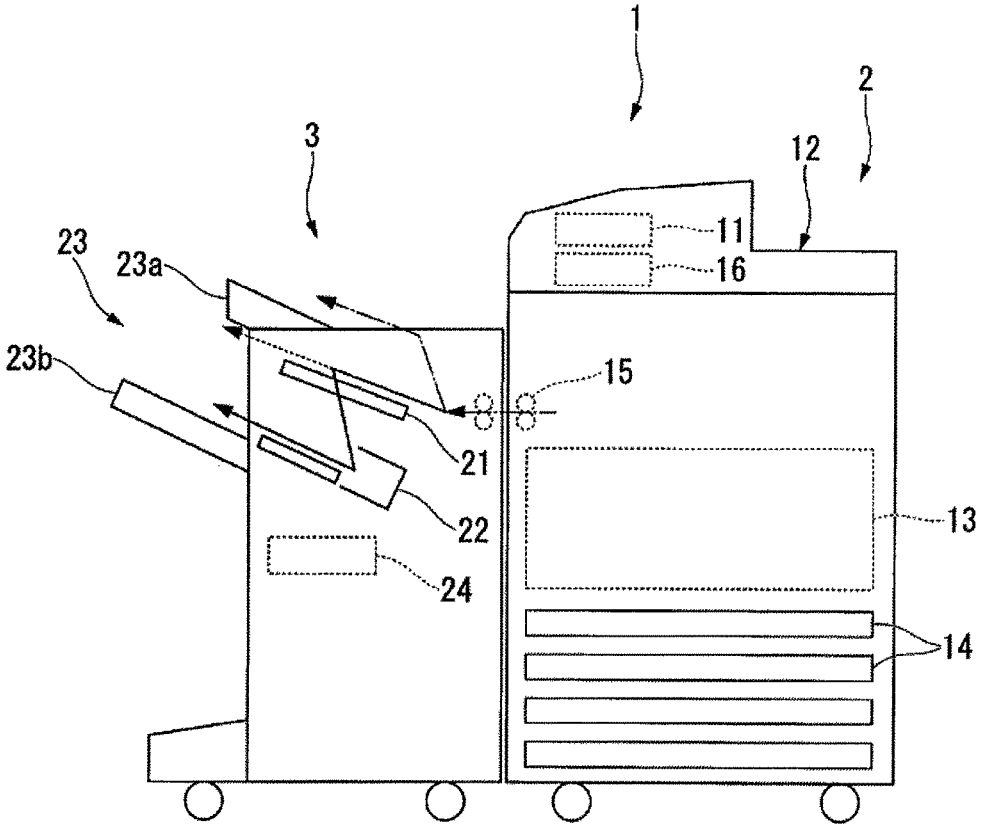
FIG. 1 is a front view showing an example of an overall configuration of an image-forming system according to an embodiment.

According to one embodiment, a sheet processing apparatus includes a transport unit and a holding unit. The transport unit transports a first sheet to a first position, the first sheet being transported first. The transport unit superimposes a second sheet on the first sheet and transports the second sheet to a second position, the second sheet being transported after the first sheet, the second position being displaced to an upstream side of a sheet transport direction relative to the first position. The transport unit superimposes a third sheet on the second sheet and transports the third sheet to a third position, the third sheet being transported after the second sheet, the third position being displaced to a downstream side of the sheet transport direction relative to the second position. The holding unit holds the first sheet at the first position when the transport unit transports the second sheet to the second position. The holding unit holds the second sheet at the second position when the transport unit transports the third sheet to the third position.

Hereinafter, a sheet processing apparatus of an embodiment will be described with reference to the drawings. It should be noted that in the following description, configurations having an identical or similar function are denoted by an identical reference symbol, and overlapping description thereof may be omitted.

A sheet processing apparatus of an embodiment will be described with reference to FIGS. 1 to 15. First, FIGS. 1 and 2 each show an example of an overall configuration of an image-forming system 1. The image-forming system 1 includes an image-forming apparatus 2 and a post-processing apparatus 3. The image-forming apparatus 2 forms an image on sheet-like media such as paper (hereinafter, described as "sheets"). The post-processing apparatus 3 performs post-processing on the sheets transported from the image-forming apparatus 2. The post-processing apparatus 3 is an example of a "sheet processing apparatus".

The image-forming apparatus 2 includes a control panel 11, a scanner 12, a printer 13, a paper feed unit 14, a paper discharge unit 15, and an image-forming control unit 16.

The control panel 11 includes various keys that receive user's operations. For example, the control panel 11 receives an input on a type of post-processing performed on sheets.

The control panel 11 transmits information on the input type of post-processing to the post-processing apparatus 3.

The scanner 12 includes a read section that reads image information of an object to be duplicated. The scanner 12 transmits the read image information to the printer 13. The printer 13 forms an output image (hereinafter, described as "toner image") by a developer such as toner on the basis of the image information transmitted from the scanner 12 or an external device. The printer 13 transfers the toner image onto a surface of a sheet. The printer 13 applies heat and pressure to the toner image transferred onto the sheet, to fix the toner image onto the sheet.

The paper feed unit 14 supplies sheets to the printer 13 one by one at a timing at which the printer 13 forms a toner image. The paper discharge unit 15 transports the sheets, which are discharged from the printer 13, to the post-processing apparatus 3.

The image-forming control unit 16 controls an overall operation of the image-forming apparatus 2. In other words, the image-forming control unit 16 controls the control panel 11, the scanner 12, the printer 13, the paper feed unit 14, and the paper discharge unit 15. The image-forming control unit 16 is a control circuit including a CPU (Central Processing Unit), a ROM (Read Only Memory), and a RAM (Random Access Memory), for example.

Next, the post-processing apparatus (sheet processing apparatus) 3 will be described. First, an overall configuration of the post-processing apparatus 3 will be described. As shown in FIG. 1, the post-processing apparatus 3 is disposed adjacently to the image-forming apparatus 2. The post-processing apparatus 3 executes post-processing on sheets transported from the image-forming apparatus 2, the post-processing being specified through the control panel 11. The post-processing includes stapling processing or sorting processing, for example. The post-processing apparatus 3 includes a standby unit 21, a processing unit 22, a discharge unit 23, and a post-processing control unit 24.

The standby unit 21 temporarily retains (buffers) sheets S (see FIG. 3) transported from the image-forming apparatus 2.

For example, the standby unit 21 keeps subsequent sheets S waiting during post-processing performed on preceding sheets S in the processing unit 22. The standby unit 21 is provided above the processing unit 22. When the processing unit 22 becomes empty, the standby unit 21 drops the retained sheets S toward the processing unit 22.

The processing unit 22 performs post-processing on the sheets S. For example, the processing unit 22 aligns the sheets S. The processing unit 22 performs stapling processing on the aligned sheets S. As a result, the sheets S are bound together. The processing unit 22 discharges the sheets S, which are subjected to the post-processing, to the discharge unit 23.

The discharge unit 23 includes a fixed tray 23*a* and a movable tray 23*b*. The fixed tray 23*a* is provided to an upper portion of the post-processing apparatus 3. The movable tray 23*b* is provided to a side portion of the post-processing apparatus 3. The fixed tray 23*a* and the movable tray 23*b* hold the sheets S that are subjected to the sorting processing and then discharged, for example.

The post-processing control unit 24 controls an overall operation of the post-processing apparatus 3. In other words, the post-processing control unit 24 controls the standby unit 21, the processing unit 22, and the discharge unit 23.

Figure 2:
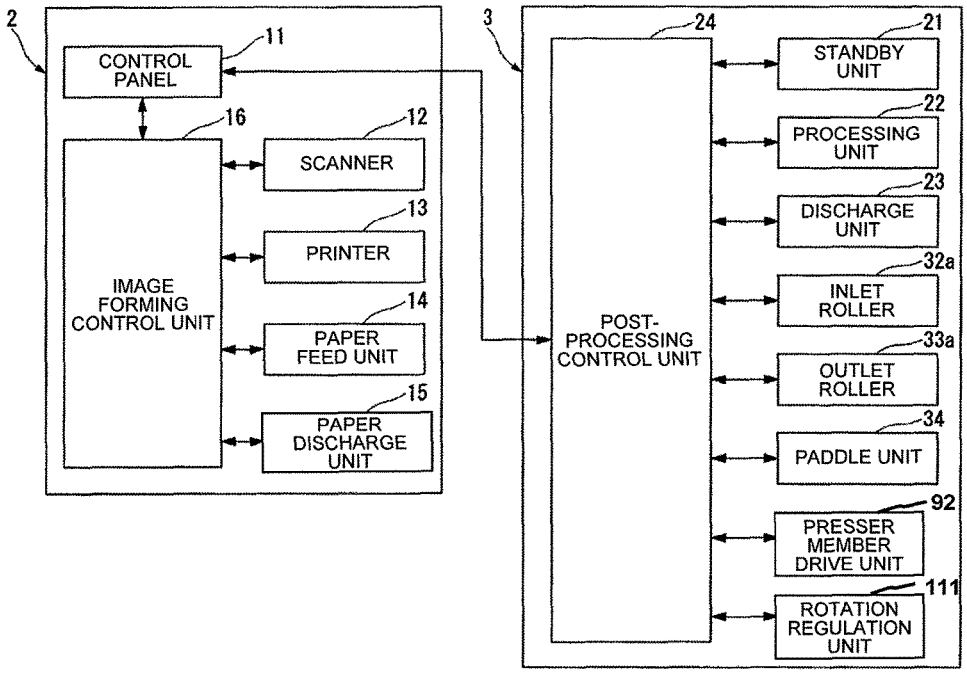
FIG. 2 is a block diagram showing an example of the overall configuration of the image-forming system shown in FIG. 1.

Further, as shown in FIG. 2, the post-processing control unit 24 controls an inlet roller 32*a*, an outlet roller 33*a*, a paddle unit 34, a presser member drive unit 92, and a rotation regulation unit 111, which will be described later.

The post-processing control unit 24 is a control circuit including a CPU, a ROM, and a RAM, for example.

Next, configurations of the sections of the post-processing apparatus 3 will be described in detail. It should be noted that in description on the following embodiment, a "sheet transport direction" means a transport direction D of the sheets S to a standby tray 41 of the standby unit 21 (entry direction of the sheets S to the standby tray 41). Further, in the description on the following embodiment, an "upstream side" and a "downstream side" mean an upstream side and a downstream side in the sheet transport direction D, respectively. Further, in the description on the following embodiment, a "rear end" means an "end of the upstream side" in the sheet transport direction D. Additionally, in the description on the following embodiment, a direction that is substantially parallel to an upper surface (transport surface) 45*b* of the standby tray 41 and is substantially orthogonal to the sheet transport direction D is described as a sheet width direction W.

Figure 3:
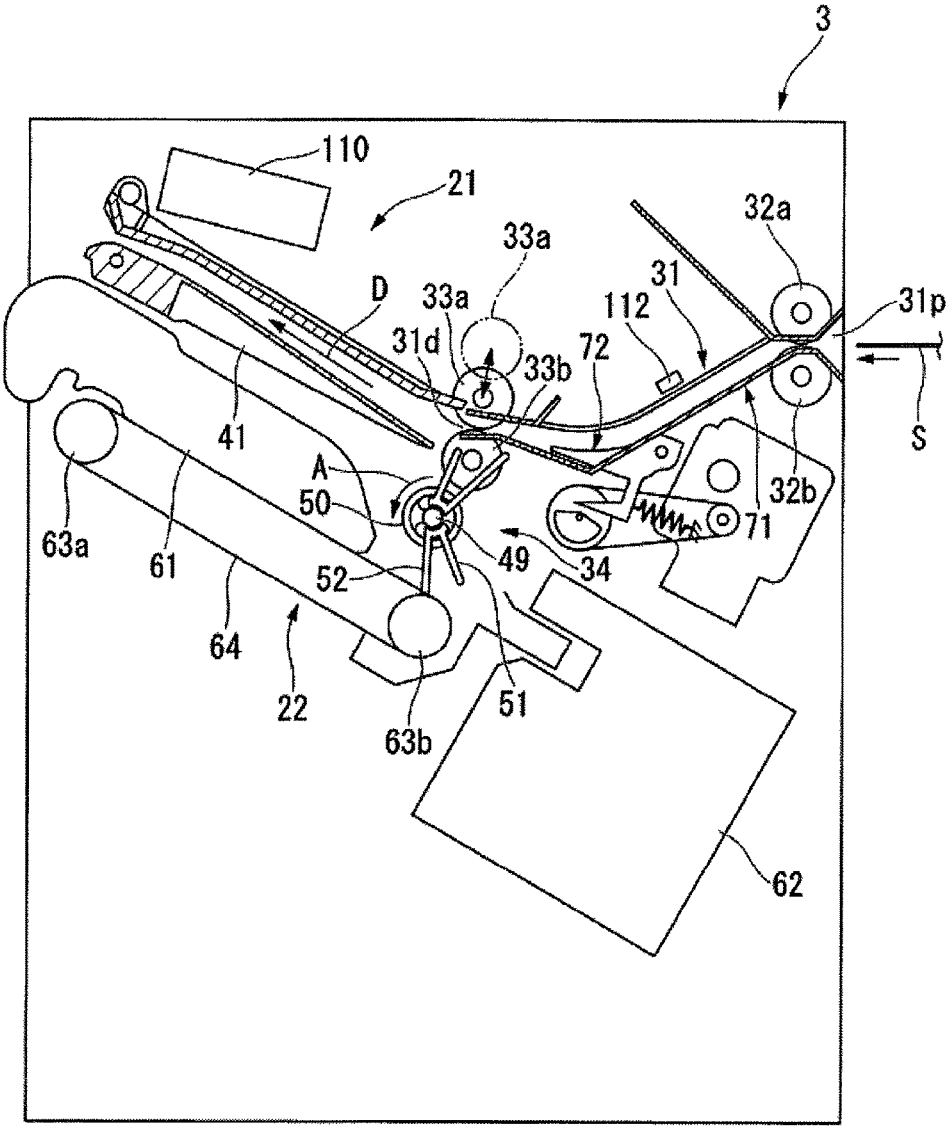
FIG. 3 is a cross-sectional view showing a configuration example of a post-processing apparatus according to the embodiment.

FIG. 3 schematically shows a configuration of the post-processing apparatus 3. As shown in FIG. 3, the post-processing apparatus 3 includes a transport path 31 for the sheets S, a pair of inlet rollers 32*a* and 32*b*, a pair of outlet rollers 33*a* and 33*b*, the standby unit 21, the paddle unit 34, and the processing unit 22.

The transport path 31 is an example of a "sheet transport path". The transport path 31 is provided inside the post-processing apparatus 3. The transport path 31 includes a sheet supply port 31*p* and a sheet discharge port 31*d*. The sheet supply port 31*p* faces the image-forming apparatus 2. The sheets S are supplied from the image-forming apparatus 2 to the sheet supply port 31*p*. Meanwhile, the sheet discharge port 31*d* is located near the standby unit 21. The sheets S that have passed through the transport path 31 are discharged from the sheet discharge port 31*d* to the standby unit 21.

The inlet rollers 32*a* and 32*b* are provided near the sheet supply port 31*p*. The inlet rollers 32*a* and 32*b* transport the sheets S, which have been supplied to the sheet supply port 31*p*, toward the downstream side of the transport path 31. For example, the inlet rollers 32*a* and 32*b* transport the sheets S, which have been supplied to the sheet supply port 31*p*, to the outlet rollers 33*a* and 33*b*.

The outlet rollers 33*a* and 33*b* are provided near the sheet discharge port 31*d*. The outlet rollers 33*a* and 33*b* receive the sheets S transported by the inlet rollers 32*a* and 32*b*. The outlet rollers 33*a* and 33*b* transport the sheets S from the sheet discharge port 31*d* to the standby unit 21.

Next, the standby unit 21 will be described. The standby unit 21 includes the standby tray (buffer tray) 41 and an opening and closing drive unit (not shown).

The rear end of the standby tray 41 is located near the outlet rollers 33*a* and 33*b*. The rear end of the standby tray 41 is located to be slightly lower than the sheet discharge port 31*d* of the transport path 31. The standby tray 41 is tilted with respect to a horizontal direction so as to gradually increase in height toward the downstream side of the sheet transport direction D. During post-processing performed on preceding sheets in the processing unit 22, the standby tray 41 holds subsequent sheets S in an overlapping manner in order to keep the subsequent sheets S waiting.

The standby tray 41 includes a first tray member and a second tray member, which are not shown in the figure. The first tray member and the second tray member are separated from each other in the sheet width direction W. The first tray member and the second tray member are movable in a mutually approaching direction and a mutually separating direction.

The opening and closing drive unit can drive the first tray member and the second tray member in the mutually approaching direction and the mutually separating direction. In the case where the sheets S wait in the standby tray 41, the opening and closing drive unit drives the first tray member and the second tray member so as to approach each other. As a result, the sheets S are supported by the first tray member and the second tray member. Meanwhile, in the case where the sheets S are moved from the standby tray 41 toward a processing tray 61 of the processing unit 22, the opening and closing drive unit drives the first tray member and the second tray member so as to separate from each other. As a result, the sheets S supported by the standby tray 41 drop toward the processing tray 61 from a gap between the first tray member and the second tray member. As a result, the sheets S are moved from the standby tray 41 to the processing tray 61.

Next, the paddle unit 34 will be described. As shown in FIG. 3, the paddle unit 34 is provided between the standby tray 41 and the processing tray 61. In the case where the sheets S are moved from the standby tray 41 toward the processing tray 61, the paddle unit 34 hits the sheets S toward the processing tray 61. Additionally, the paddle unit 34 moves the sheets S, which have dropped on the processing tray 61, toward a stapler 62 that will be described later. Specifically, the paddle unit 34 includes a rotating shaft 49, a rotating body 50, first paddles 51, and second paddles 52.

The rotating shaft 49 is the center of rotation of the rotating body 50 of the paddle unit 34. The rotating shaft 49 extends in the sheet width direction W. The paddle unit 34 is rotated about the rotating shaft 49 in a direction of an arrow A in FIG. 3. The rotating body 50 is cylindrically formed. The rotating body 50 is rotated about the rotating shaft 49. The rotating body 50 is provided with the first paddles 51 and the second paddles 52.

The first paddles 51 and the second paddles 52 protrude from the rotating body 50 in a radial direction of the rotating body 50. The first paddles 51 and the second paddles 52 are each formed of an elastic member such as rubber.

The first paddles 51 are rotated at a timing at which the sheets S are moved from the standby tray 41 toward the processing tray 61, and thus hit the sheets S toward the processing tray 61.

The second paddles 52 are located behind the respective first paddles 51 in the rotation direction of the rotating body 50 of the paddle unit 34. The length of each second paddle 52 is larger than that of each first paddle 51 in the radial direction of the rotating body 50. The second paddles 52 are rotated to come into contact with the upper surface of a sheet S, which is located at the uppermost position in the sheets S that have dropped on the processing tray 61. The second paddles 52 are further rotated in the state of being in contact with the upper surface of the sheet S, and thus move the sheet S toward the stapler 62.

Next, the processing unit 22 will be described. The processing unit 22 includes the processing tray 61, the stapler 62, transport rollers 63*a* and 63*b*, and a transport belt 64.

The processing tray 61 is provided below the standby tray 41. The processing tray 61 is tilted with respect to the horizontal direction so as to gradually increase in height toward the downstream side of the sheet transport direction D. For example, the processing tray 61 is tilted substantially parallel to the standby tray 41.

The stapler 62 is provided to an end of the processing tray 61. The stapler 62 performs stapling (binding) processing on a batch of a predetermined number of sheets S located on the processing tray 61.

The transport rollers 63*a* and 63*b* are disposed with a predetermined interval therebetween in the sheet transport direction D. The transport belt 64 is stretched over the transport rollers 63*a* and 63*b*. The transport belt 64 is rotated in synchronization with the transport rollers 63*a* and 63*b*. The transport belt 64 transports the sheets S between the stapler 62 and the discharge unit 23.

Next, a configuration to superimpose the sheets S on one another in a predetermined state will be described. The post-processing apparatus 3 of this embodiment has a function of superimposing a second sheet S2 (an intermediate sheet), which is sandwiched between a first sheet S1 (a sheet located at the lowermost position) and a third sheet S3 (a sheet located at the uppermost position), in a position displaced to the upstream side of the sheet transport direction D relative to the first sheet S1 and the third sheet S3, as shown in FIG. 10E. Hereinafter, the configuration to achieve this function will be described in detail.

Figure 4:
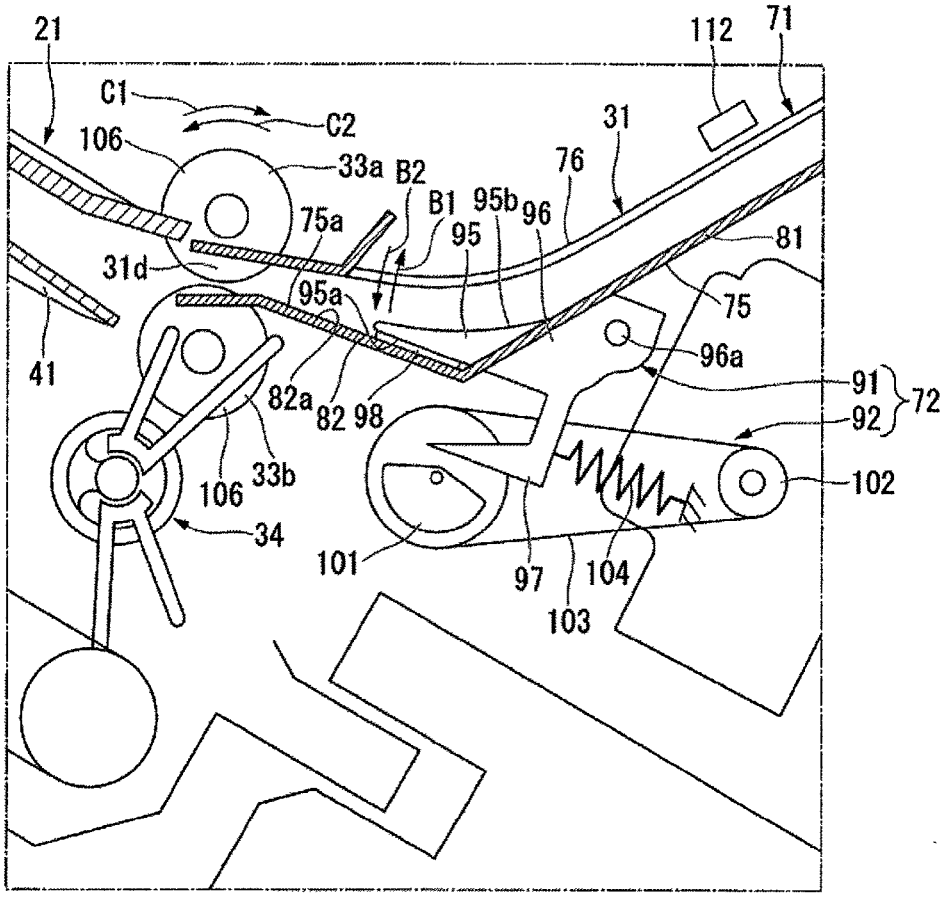
FIG. 4 is a cross-sectional view showing a sheet transport path shown in FIG. 3.

FIG. 4 shows a configuration of the transport path 31 of the post-processing apparatus 3 and a neighboring portion thereof. As shown in FIG. 4, the post-processing apparatus 3 includes a guide 71 and a rear end chuck 72.

The guide 71 is disposed along the transport path 31. The guide 71 is a member made of metal or plastic. The sheets S are guided by the guide 71 and thus transported through the transport path 31. The guide 71 includes a first guide member 75 and a second guide member 76. The first guide member 75 is provided under the transport path 31. The second guide member 76 is provided above the transport path 31. The first guide member 75 forms a lower surface of the transport path 31. An upper surface 75*a* of the first guide member 75 is an example of a "sheet transport surface" on which the sheets S are transported. The second guide member 76 is located on the opposite side to the first guide member 75 relative to the transport path 31. The second guide member 76 forms an upper surface of the transport path 31.

More specifically, as shown in FIG. 4, the first guide member 75 includes a first portion 81 and a second portion 82. The first portion 81 is located on the upstream side of the sheet transport direction D relative to the second portion 82.

The first portion 81 is tilted with respect to the horizontal direction so as to gradually decrease in height toward the downstream side of the sheet transport direction D.

The second portion 82 further extends to the downstream side from the end of the downstream side of the first portion 81. The second portion 82 extends in a direction intersecting with the first portion 81. The second portion 82 is tilted with respect to the horizontal direction so as to gradually increase in height toward the downstream side of the sheet transport direction D.

Figure 5:
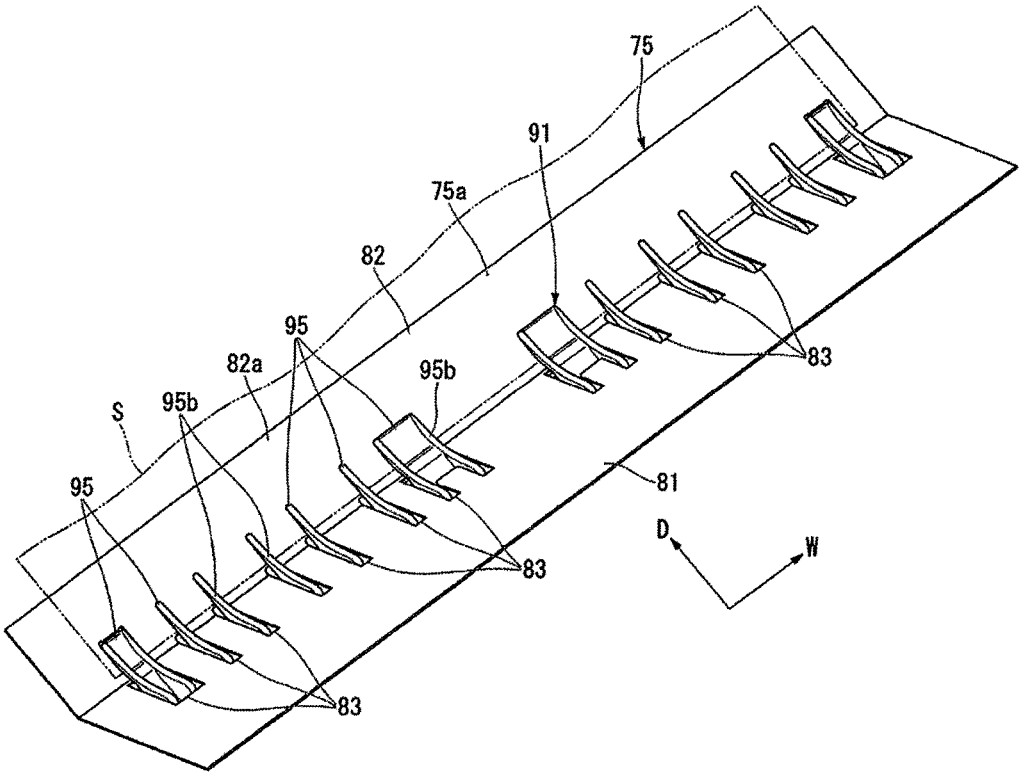
FIG. 5 is a perspective view showing a part of the sheet transport path shown in FIG. 3.

FIG. 5 shows the upper surface 75*a* of the first guide member 75. As shown in FIG. 5, the first guide member 75 has a larger width than the sheets S in the sheet width direction W. Through-holes 83 are provided in the first portion 81 of the first guide member 75. The through-holes 83 are aligned with one another in the sheet width direction W. Each of the through-holes 83 is an elongate hole extending toward the second portion 82.

Next, the rear end chuck 72 will be described. As shown in FIG. 4, the rear end chuck 72 is provided in the middle of the transport path 31. The rear end chuck 72 has a function of holding the rear end of the sheets S inside the transport path 31. The rear end chuck 72 includes a presser member 91 and a presser member drive unit 92 that drives the presser member 91.

Figure 6:
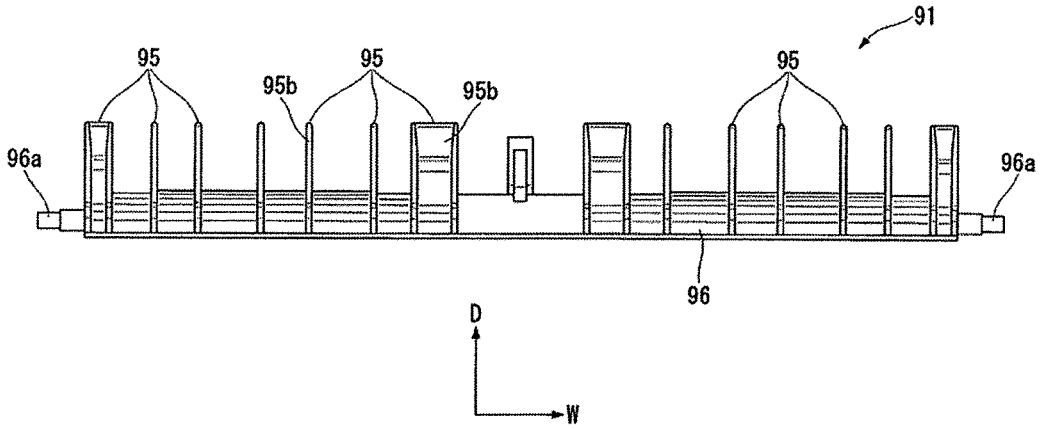
FIG. 6 is a plan view showing a presser member shown in FIG. 4.

FIG. 6 is a plan view showing the presser member 91. As shown in FIG. 6, the presser member 91 includes pressing portions 95, a turning portion 96, and a protruding portion 97 (see FIG. 4).

The pressing portions 95 are aligned with one another in the sheet width direction W. As shown in FIG. 5, each of the pressing portions 95 of the presser member 91 protrudes to the inside of the transport path 31 through the corresponding through-hole 83 of the first guide member 75 (see FIG. 5). As shown in FIG. 4, each of the pressing portions 95 includes a bottom surface 95*a* and an upper surface 95*b*. In the state shown in FIG. 4 (a closed position that will be described later), the bottom surface 95*a* of each of the pressing portions 95 faces an upper surface 82*a* of the second portion 82 of the first guide member 75 substantially parallel thereto. The pressing portions 95 can sandwich the rear end of the sheets S between the bottom surfaces 95*a* of the pressing portions 95 and the upper surface 82*a* of the second portion 82 of the first guide member 75. Further, a friction member 98 is attached to each of the bottom surfaces 95*a* of the pressing portions 95. The friction member 98 is a member having a relatively large friction resistance, such as rubber.

The upper surface 95*b* of each of the pressing portions 95 has an arc-like shape that smoothly connects the first portion 81 and the second portion 82 of the first guide member 75. The sheets S transported along the first portion 81 of the first guide member 75 are guided by the upper surfaces 95*b* of the pressing portions 95, and thus smoothly transported to the second portion 82 of the first guide member 75.

As shown in FIG. 6, the turning portion 96 extends in the sheet width direction W. The turning portion 96 couples the pressing portions 95 to one another. As shown in FIG. 4, the turning portion 96 is provided to the outside of the transport path 31. For example, the turning portion 96 is provided under the first guide member 75. The turning portion 96 includes a turning shaft 96*a* that extends in the sheet width direction W. The presser member 91 is turned about the turning shaft 96*a*. As shown in FIG. 4, the protruding portion 97 protrudes downward from the turning portion 96. In other words, the protruding portion 97 protrudes from the turning portion 96 in a radial direction of the turning shaft 96*a*.

The presser member drive unit 92 includes a cam 101, a drive source 102, a drive belt 103, and a spring 104. The cam 101 comes into contact with the protruding portion 97 of the presser member 91. The cam 101 is rotated by the drive source 102 and the drive belt 103. When the cam 101 is rotated, the protruding portion 97 of the presser member 91 is pushed up. As a result, the presser member 91 is rotated in a direction of an arrow B1 in FIG. 4. The spring 104 is coupled to the protruding portion 97 of the presser member 91. The spring 104 biases the protruding portion 97 such that the presser member 91 rotates in a direction of an arrow B2 in FIG. 4.

By the configuration as described above, the presser member 91 of this embodiment is movable among a closed position (holding position), an opened position, and a release position.

Figure 7A:
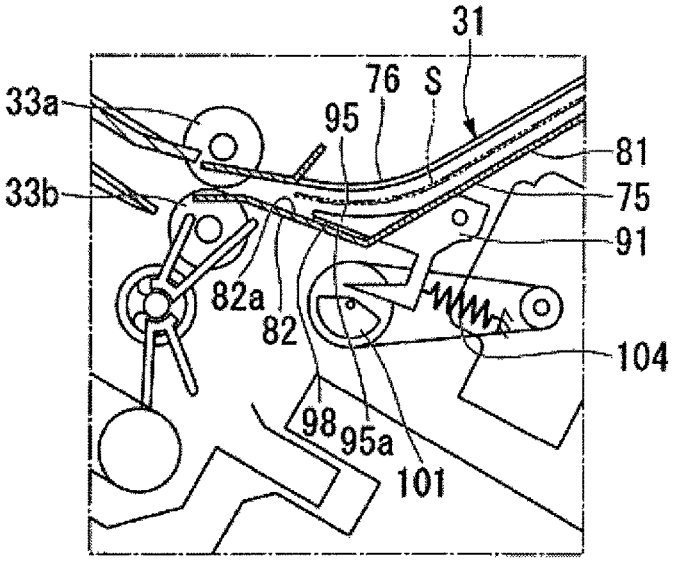
FIG. 7A is a cross-sectional view showing a movement of the presser member shown in FIG. 4.

FIG. 7A shows the presser member 91 in the closed position. In the closed position, the bottom surfaces 95*a* of the presser member 91 are substantially parallel to the upper surface 82*a* of the second portion 82 of the first guide member 75. The presser member 91 can sandwich the rear end of the sheets S between the presser member 91 and the second portion 82 of the first guide member 75. The sheets S sandwiched between the presser member 91 and the second portion 82 of the first guide member 75 come into contact with the friction members 98 of the presser member 91. Further, the presser member 91 is biased by the spring 104 toward the second portion 82 of the first guide member 75. Thus, the sheets S sandwiched between the presser member 91 and the second portion 82 of the first guide member 75 are held relatively tightly. Further, in the closed position described above, the presser member 91 is separated from the second guide member 76. Specifically, the presser member 91 opens the transport path 31. In other words, the presser member 91 permits the transport of the sheets S in the transport path 31. The sheets S can pass through on the upper portion of the presser member 91 to be transported to the standby tray 41.

Figure 7B:
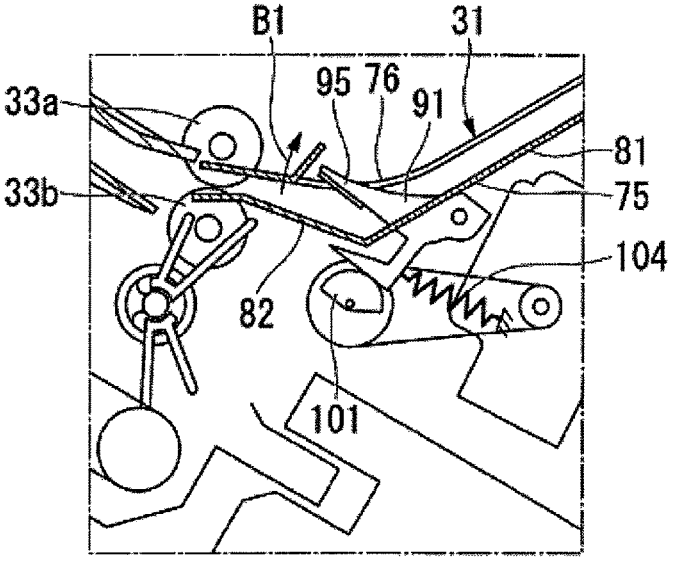
FIG. 7B is a cross-sectional view showing a movement of the presser member shown in FIG. 4.

FIG. 7B shows the presser member 91 in the opened position. The opened position is a position at which the presser member 91 is rotated in a direction of an arrow B1 in FIG. 7B from the closed position (FIG. 7A). In the opened position, the presser member 91 separates from the second portion 82 of the first guide member 75. Thus, the sheets S can be inserted between the presser member 91 and the second portion 82 of the first guide member 75. Further, in the opened position, the pressing portions 95 of the presser member 91 intersect with the second guide member 76. In other words, at least a part of the bottom surface 95*a* of each pressing portion 95 is located above the second guide member 76. Thus, the transport path 31 enters a closed state by the presser member 91. In other words, in the case where the presser member 91 is in the opened position, the sheets S transported in the opposite direction to the sheet transport direction D, which will be described later, are not inversely transported beyond the presser member 91. Thus, the sheets S transported in the opposite direction to the sheet transport direction D are reliably inserted between the presser member 91 and the second portion 82 of the first guide member 75.

Figure 7C:
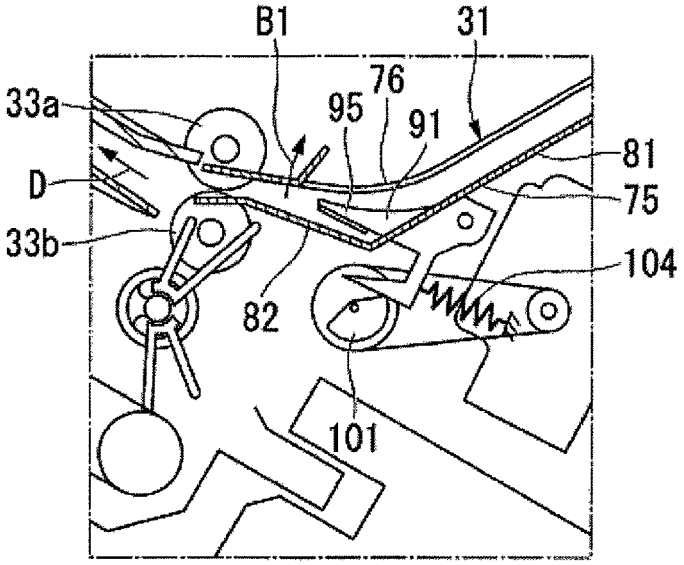
FIG. 7C is a cross-sectional view showing a movement of the presser member shown in FIG. 4.

FIG. 7C shows the presser member 91 in the release position. The release position is a position located between the closed position and the opened position. The release position is a position at which the presser member 91 is slightly rotated in a direction of an arrow B1 in FIG. 7C from the closed position (FIG. 7A). In the release position, the bottom surfaces 95*a* of the presser member 91 are slightly separated from the upper surface 82*a* of the second portion 82 of the first guide member 75. In the release position, the holding state of the sheets S located between the presser member 91 and the second portion 82 of the first guide member 75 is released. Thus, the sheets S located between the presser member 91 and the second portion 82 of the first guide member 75 are movable in the sheet transport direction D. Further, in the release position, the presser member 91 is separated from the second guide member 76. In other words, in the release position, the pressing portions 95 of the presser member 91 stop between the first guide member 75 and the second guide member 76. Thus, the presser member 91 permits the transport of the sheets S in the transport path 31. The sheets S can pass through on the upper portion of the presser member 91 to be transported to the standby tray 41.

Next, the outlet rollers 33*a* and 33*b* described above will be described in detail. It should be noted that hereinafter, for convenience of description, one outlet roller 33*a* is described as an "outlet turning roller 33*a*", and the other outlet roller 33*b* is described as an "outlet roller 33*b*".

The outlet turning roller 33*a* is an example of a "transport unit". The outlet turning roller 33*a* is a drive roller that is driven by a drive source (for example, motor) (not shown). As shown in FIG. 4, the outlet turning roller 33*a* is provided above the transport path 31. The outlet turning roller 33*a* is rotatable in a normal direction (direction C1 in FIG. 4) and a reverse direction (direction C2 in FIG. 4). At least a circumferential surface of the outlet turning roller 33*a* includes a friction member 106. The friction member 106 is a member having a relatively large friction resistance, such as rubber. The description of "at least a circumferential surface includes a friction member" means that a friction member may be attached to the circumferential surface of the roller or the entire roller may be formed of a friction member.

As shown in FIG. 3, the outlet turning roller 33*a* is movable between a transport position (see a solid line in FIG. 3) and a retraction position (see a chain double-dashed line in FIG. 3). In the transport position, the sheets S are sandwiched between the outlet turning roller 33*a* and the outlet roller 33*b*. The sheets S are transported in the sheet transport direction D or in the opposite direction thereto by the rotation of the outlet turning roller 33*a*. On the other hand, in the retraction position, the outlet turning roller 33*a* is retracted upward so as not to come into contact with the sheets S. In other words, the retraction position is a position at which the nip of the outlet turning roller 33*a* with respect to the sheets S is released. The outlet turning roller 33*a* is driven by a turning device 110 such as a solenoid, and thus moves between the transport position and the retraction position.

The outlet roller 33*b* is a driven roller (pinch roller) that rotates in association with the rotation of the outlet turning roller 33*a*. The outlet roller 33*b* is provided under the transport path 31. Similar to the outlet turning roller 33*a*, at least a circumferential surface of the outlet roller 33*b* includes a friction member 106.

The post-processing apparatus 3 includes a rotation regulation unit 111 (see FIG. 13) that regulates the rotation of the outlet roller 33*b* so as to make the outlet roller 33*b* unrotatable. The outlet roller 33*b* and the rotation regulation unit 111 are each an example of a "friction member". The friction member can hold the sheets S at a predetermined position (a first position and a second position that will be described later), apart from the presser member 91. Further, the friction member and the presser member 91 are each an example of a "holding unit". The holding unit holds the sheets S at a predetermined position (the first position and the second position that will be described later) by using the friction member and the presser member 91. It should be noted that the rotation regulation unit 111 will be described in detail.

As shown in FIG. 3, the post-processing apparatus 3 includes a sensor 112 that can detect the sheets S. The sensor 112 is provided in the middle of the transport path 31. The post-processing control unit 24 can detect a transport position of the sheets S on the basis of a detection result of the sensor 112. For example, on the basis of a detection result of the sensor 112, the post-processing control unit 24 detects that the sheets S reach a position under the outlet turning roller 33*a*.

Next, with reference to FIGS. 8A to 10O, a method of superimposing a second sheet S2 as at least one sheet (for example, some sheets), which is sandwiched between a first sheet S1 and a third sheet S3, to be displaced to the upstream side of the sheet transport direction D relative to the first sheet S1 and the third sheet S3 will be described. It should be noted that the case where two second sheets S2*a* and S2*b* are sandwiched between the first sheet S1 and the third sheet S3 will be hereinafter exemplified.

Figure 8A:
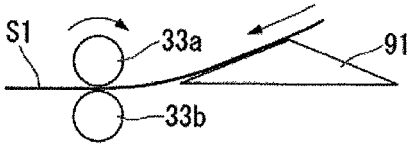
FIG. 8A is a view showing movements of the presser member and outlet rollers shown in FIG. 4.

FIG. 8A shows a state where the first sheet S1 is transported. In this state, the presser member 91 is in the closed position. The outlet turning roller 33*a* is in the transport position. The outlet roller 33*b* is in a rotatable state. The first sheet S1 is transported by the outlet turning roller 33*a*. As a result, the first sheet S1 is transported to the downstream side of the presser member 91.

Figure 8B:
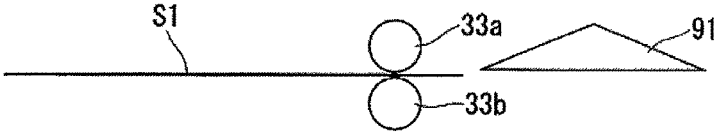
FIG. 8B is a view showing movements of the presser member and the outlet rollers shown in FIG. 4.

FIG. 8B shows a state where the first sheet S1 is transported to a position at which the first sheet S1 does not interfere with the presser member 91. In this state, the rotation of the outlet turning roller 33*a* is stopped. As a result, the transport of the first sheet S1 is stopped temporarily.

Figure 8C:
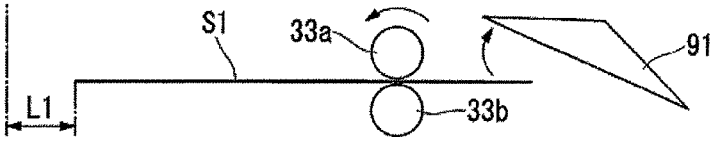
FIG. 8C is a view showing movements of the presser member and the outlet rollers shown in FIG. 4.

FIG. 8C shows a state where the first sheet S1 is inserted between the presser member 91 and the first guide member 75 (see FIG. 4). In this state, the presser member 91 moves to the opened position. The outlet turning roller 33*a* is in the transport position. The outlet roller 33*b* is in the rotatable state. The outlet turning roller 33*a* transports (i.e., feeds backward) the first sheet S1 in the opposite direction to the sheet transport direction D by a first distance L1. As a result, the first sheet S1 is inserted between the presser member 91 and the first guide member 75. As a result, the first sheet S1 is transported to a first position. The presser member 91 moves to the closed position after the first sheet S1 is transported to the first position. As a result, the presser member 91 holds the first sheet S1 at the first position. The outlet turning roller 33*a* moves to the retraction position after the first sheet S1 is held at the first position. The rotation of the outlet roller 33*b* is regulated by the rotation regulation unit 111 after the first sheet S1 is held at the first position. In other words, the outlet roller 33*b* enters an unrotatable state.

Figure 8D:
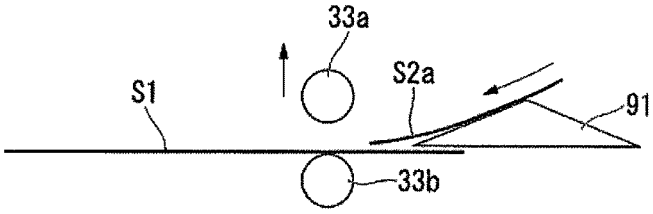
FIG. 8D is a view showing movements of the presser member and the outlet rollers shown in FIG. 4.

FIG. 8D shows a state where the second sheet S2*a* as a first one of the second sheets is transported. In this state, the presser member 91 is in the closed position. The outlet turning roller 33*a* is in the retraction position. Thus, the outlet turning roller 33*a* does not apply a transport force to the first sheet S1. The outlet roller 33*b* is in the unrotatable state. The second sheet S2*a* is transported by the inlet rollers 32*a* and 32*b* (see, for example, FIG. 3). As a result, the second sheet S2*a* is transported to a position under the outlet turning roller 33*a*. When the second sheet S2*a* reaches the position under the outlet turning roller 33*a*, the post-processing control unit 24 detects that the second sheet S2*a* reaches the position under the outlet turning roller 33*a* on the basis of a detection result of the sensor 112.

Figure 8E:
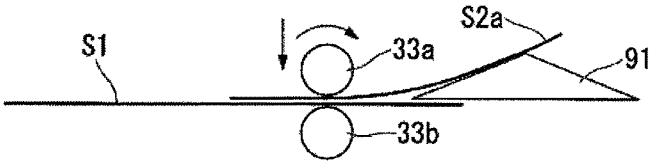
FIG. 8E is a view showing movements of the presser member and the outlet rollers shown in FIG. 4.

FIG. 8E shows a state where the second sheet S2*a* is transported to the position under the outlet turning roller 33*a*. In this state, the outlet turning roller 33*a* moves from the retraction position to the transport position. The second sheet S2*a* is transported to the downstream side of the presser member 91 by the outlet turning roller 33*a*. On the other hand, the presser member 91 is in the closed position. Further, the outlet roller 33*b* is in the unrotatable state. Thus, the first sheet S1 is held at the first position.

Figure 9A:
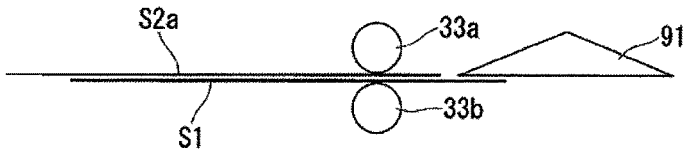
FIG. 9A is a cross-sectional view showing movements of the presser member and the outlet rollers shown in FIG. 4.

FIG. 9A shows a state where the second sheet S2*a* is transported to a position at which the second sheet S2*a* does not interfere with the presser member 91. In this state, the rotation of the outlet turning roller 33*a* is stopped. As a result, the transport of the second sheet S2*a* is stopped temporarily.

Figure 9B:
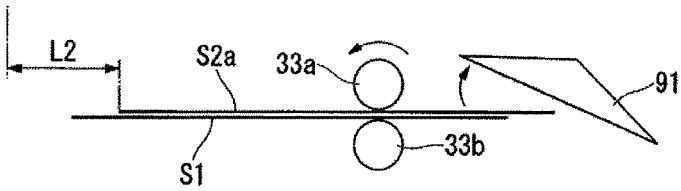
FIG. 9B is a cross-sectional view showing movements of the presser member and the outlet rollers shown in FIG. 4.

FIG. 9B shows a state where the second sheet S2*a* is inserted between the presser member 91 and the first guide member 75. In this state, the presser member 91 is moved to the opened position. The outlet turning roller 33*a* is in the transport position. The outlet turning roller 33*a* transports the second sheet S2*a* in the opposite direction to the sheet transport direction D by a second distance L2. As a result, the second sheet S2*a* is inserted between the presser member 91 and the first guide member 75. At that time, the outlet roller 33*b* is in the unrotatable state. The outlet roller 33*b* holds the first sheet S1 at the first position. Here, the transport distance (second distance L2) of the second sheet S2*a* in the opposite direction to the sheet transport direction D is set to be longer than the transport distance (first distance L1) of the first sheet S1 in the opposite direction to the sheet transport direction D. As a result, the second sheet S2*a* is superimposed on the first sheet S1 and also transported to a second position that is displaced to the upstream side of the sheet transport direction D relative to the first position. The presser member 91 moves to the closed position after the second sheet S2*a* is transported to the second position. As a result, the presser member 91 presses the first sheet S1 located at the first position and the second sheet S2*a* located at the second position toward the first guide member 75. In other words, the presser member 91 presses the first sheet S1 and the second sheet S2*a* toward the first guide member 75 in a state where the second sheet S2*a* is superimposed on the first sheet S1. As a result, the presser member 91 holds the first sheet S1 at the first position and also holds the second sheet S2*a* at the second position. The outlet turning roller 33*a* moves to the retraction position after the second sheet S2*a* is held at the second position.

Figure 9C:
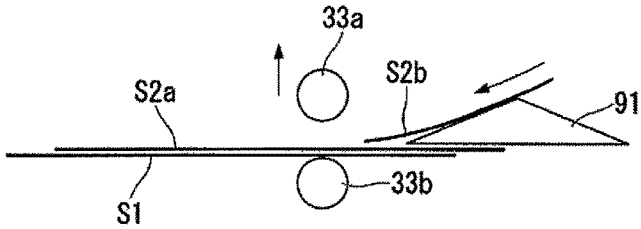
FIG. 9C is a cross-sectional view showing movements of the presser member and the outlet rollers shown in FIG. 4.

FIG. 9C shows a state where the second sheet S2*b* as a second one of the second sheets is transported. It should be noted that the transport of the second sheet S2*b* as a second one of the second sheets is substantially the same as the transport of the second sheet S2*a* as a first one of the second sheets. In other words, in the state shown in FIG. 9C, the presser member 91 is in the closed position. The outlet turning roller 33*a* is in the retraction position. Thus, the outlet turning roller 33*a* does not apply a transport force to the first sheet S1 and the second sheet S2*a*. The outlet roller 33*b* is in the unrotatable state. The second sheet S2*b* is transported by the inlet rollers 32*a* and 32*b* (see, for example, FIG. 3). As a result, the second sheet S2*b* is transported to the position under the outlet turning roller 33*a*. When the second sheet S2*b* reaches the position under the outlet turning roller 33*a*, the post-processing control unit 24 detects that the second sheet S2*b* reaches the position under the outlet turning roller 33*a* on the basis of a detection result of the sensor 112.

Figure 9D:
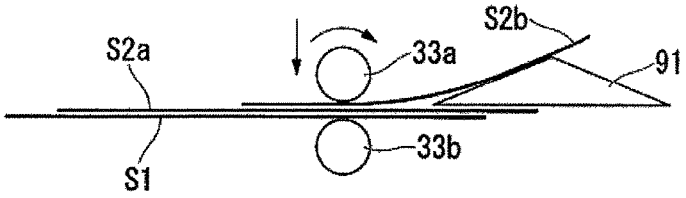
FIG. 9D is a cross-sectional view showing movements of the presser member and the outlet rollers shown in FIG. 4.

FIG. 9D shows a state where the second sheet S2*b* is transported to the position under the outlet turning roller 33*a*. In this state, the outlet turning roller 33*a* moves from the retraction position to the transport position. The second sheet S2*b* is transported to the downstream side of the presser member 91 by the outlet turning roller 33*a*. On the other hand, the presser member 91 is in the closed position. Further, the outlet roller 33*b* is in the unrotatable state. Thus, the first sheet S1 is held at the first position. Further, the second sheet S2*a* as a first one of the second sheets is held at the second position.

Figure 9E:
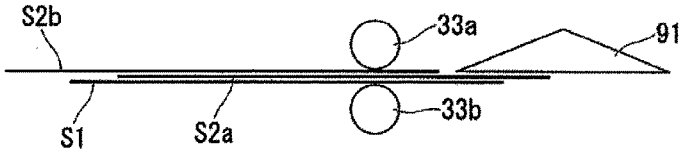
FIG. 9E is a cross-sectional view showing movements of the presser member and the outlet rollers shown in FIG. 4.

FIG. 9E shows a state where the second sheet S2*b* is transported to a position at which the second sheet S2*b* does not interfere with the presser member 91. In this state, the rotation of the outlet turning roller 33*a* is stopped. As a result, the transport of the second sheet S2*b* is stopped temporarily.

Figure 10A:
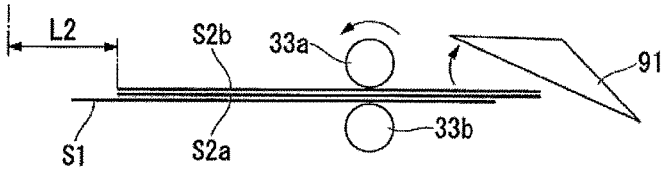
FIG. 10A is a cross-sectional view showing movements of the presser member and the outlet rollers shown in FIG. 4.

FIG. 10A shows a state where the second sheet S2*b* is inserted between the presser member 91 and the first guide member 75. In this state, the presser member 91 is moved to the opened position. The outlet turning roller 33*a* is in the transport position. The outlet turning roller 33*a* transports the second sheet S2*b* in the opposite direction to the sheet transport direction D by the second distance L2. As a result, the second sheet S2*b* is inserted between the presser member 91 and the first guide member 75. At that time, the outlet roller 33*b* is in the unrotatable state. The outlet roller 33*b* holds the first sheet S1 at the first position. Further, the outlet roller 33*b* holds the second sheet S2*a* as a first one of the second sheets at the second position. The presser member 91 moves to the closed position after the second sheet S2*b* is transported to the second position. As a result, the presser member 91 presses the first sheet S1 located at the first position and the two second sheets S2*a* and S2*b* located at the second position toward the first guide member 75. In other words, the presser member 91 presses the first sheet S1 and the second sheets S2*a* and S2*b* toward the first guide member 75 in a state where the two second sheets S2*a* and S2*b* are superimposed on the first sheet S1. As a result, the presser member 91 holds the first sheet S1 at the first position and also holds the two second sheets S2*a* and S2*b* at the second position. The outlet turning roller 33*a* moves to the retraction position after the second sheets S2*a* and S2*b* are held at the second position. In the case where there are three or more second sheets S2, the above operation is similarly repeated.

Figure 10B:
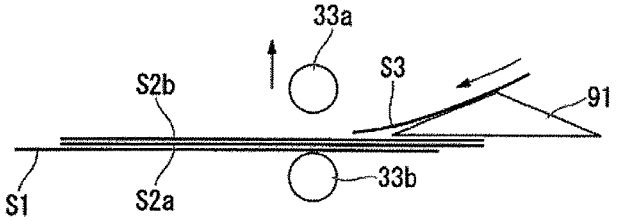
FIG. 10B is a cross-sectional view showing movements of the presser member and the outlet rollers shown in FIG. 4.

FIG. 10B shows a state where a third sheet S3 (last sheet) is transported. In this state, the presser member 91 is in the closed position. The outlet turning roller 33*a* is in the retraction position. Thus, the outlet turning roller 33*a* does not apply a transport force to the first sheet S1 and the second sheets S2*a* and S2*b*. The outlet roller 33*b* is in the unrotatable state. The third sheet S3 is transported by the inlet rollers 32*a* and 32*b* (see, for example, FIG. 3). As a result, the third sheet S3 is transported to the position under the outlet turning roller 33*a*. When the third sheet S3 reaches the position under the outlet turning roller 33*a*, the post-processing control unit 24 detects that the third sheet S3 reaches the position under the outlet turning roller 33*a* on the basis of a detection result of the sensor 112.

Figure 10C:
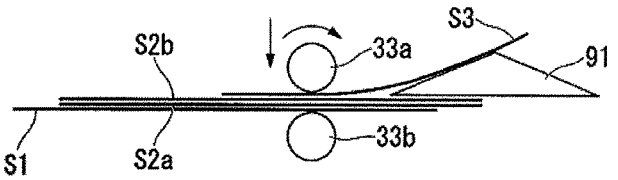
FIG. 10C is a cross-sectional view showing movements of the presser member and the outlet rollers shown in FIG. 4.

FIG. 10C shows a state where the third sheet S3 is transported to the position under the outlet turning roller 33*a*. In this state, the outlet turning roller 33*a* moves from the retraction position to the transport position. The outlet turning roller 33*a* transports the third sheet S3 to a third position at which the third sheet S3 is superimposed on the second sheets S2*a* and S2*b* and which is displaced to the downstream side of the sheet transport direction relative to the second position. On the other hand, the presser member 91 is in the closed position. Further, the outlet roller 33*b* is in the unrotatable state. Thus, the first sheet S1 is held at the first position. Further, the two second sheets S2*a* and S2*b* are held at the second position.

Figure 10D:
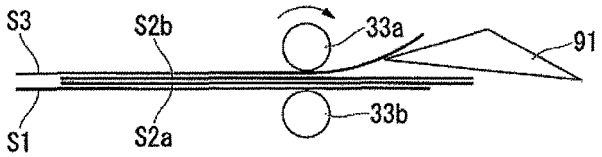
FIG. 10D is a cross-sectional view showing movements of the presser member and the outlet rollers shown in FIG. 4.
Figure 10E:
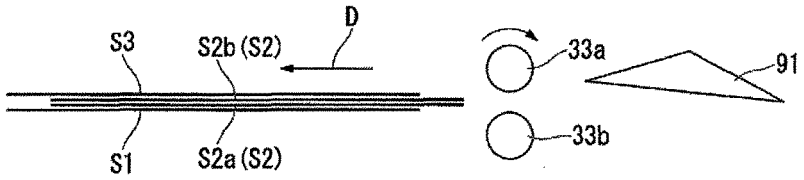
FIG. 10E is a cross-sectional view showing movements of the presser member and the outlet rollers shown in FIG. 4.

FIG. 10D shows a state where the third sheet S3 is transported to the third position. In this state, the presser member 91 moves to the release position according to a timing at which the third sheet S3 reaches the third position. Further, according to a timing at which the third sheet S3 reaches the third position, the rotation regulation of the outlet roller 33*b* is released. As a result, the first sheet S1 and the second sheets S2*a* and S2*b* can be transported together with the third sheet S3.

FIG. 10E shows a state where the first sheet S1, the second sheets S2*a* and S2*b*, and the third sheet S3 are transported to the downstream side of the outlet turning roller 33*a*. The first sheet S1, the second sheets S2*a* and S2*b*, and the third sheet S3 are transported to the standby tray 41 in a state where the second sheets S2*a* and S2*b* are displaced to the upstream side of the sheet transport direction D relative to the first sheet S1 and the third sheet S3.

Figure 11A:
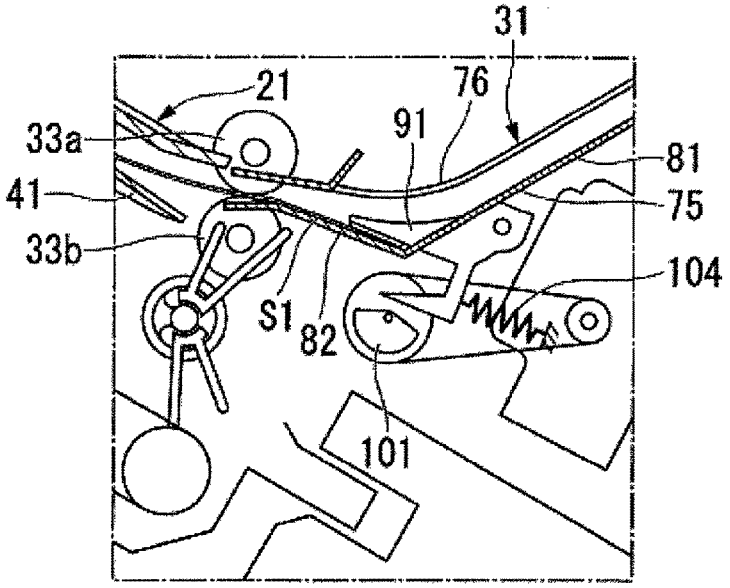
FIG. 11A is a cross-sectional view showing a sheet holding position with respect to the sheet transport path shown in FIG. 3.
Figure 11B:
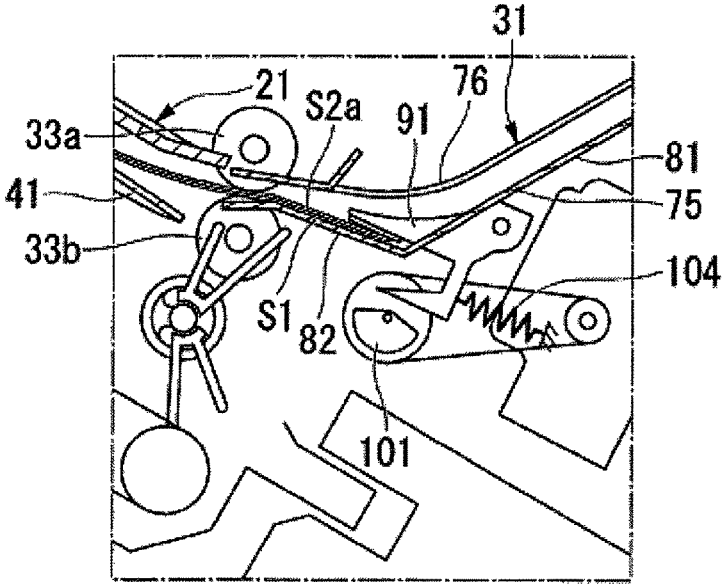
FIG. 11B is a cross-sectional view showing a sheet holding position with respect to the sheet transport path shown in FIG. 3.
Figure 11C:
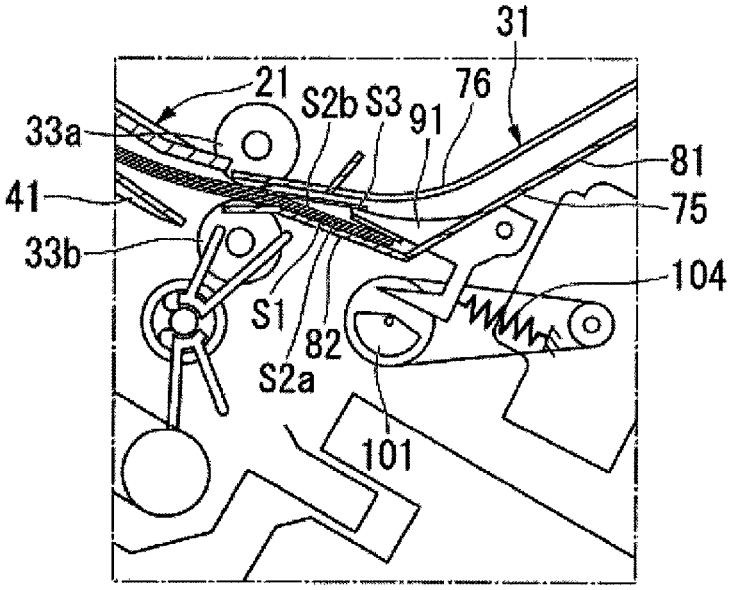
FIG. 11C is a cross-sectional view showing a sheet holding position with respect to the sheet transport path shown in FIG. 3.

FIGS. 11A, 11B, and 11C each show an actual holding position of the sheets S1, S2*a*, S2*b*, and S3 during operations related to FIGS. 8A to 10O. FIG. 11A shows the first sheet S1 held at the first position. FIG. 11B shows the first sheet S1 held at the first position and the second sheet S2*a* held at the second position. FIG. 11C shows the first sheet S1 held at the first position, the second sheets S2*a* and S2*b* held at the second position, and the third sheet S3 transported to the third position.

As shown in FIGS. 11A, 11B, and 11C, a part of the first sheet S1 located at the first position remains in the transport path 31. Similarly, a part of each of the second sheets S2*a* and S2*b* located at the second position remains in the transport path 31. The presser member 91 holds a part of each of the first sheet S1 and second sheets S2*a* and S2*b* within the transport path 31.

In this embodiment, the first sheet S1, the second sheets S2*a* and S2*b*, and the third sheet S3 are transported from the transport path 31 to the standby tray 41 in a state where the second sheets S2*a* and S2*b* are superimposed to be displaced to the upstream side of the sheet transport direction D relative to the first sheet S1 and the third sheet S3. Further, the first sheet S1, the second sheets S2*a* and S2*b*, and the third sheet S3 drop from the standby tray 41 to the processing tray 61 in a state where the second sheets S2*a* and S2*b* are superimposed to be displaced to the upstream side of the sheet transport direction D relative to the first sheet S1 and the third sheet S3.

Figure 12:
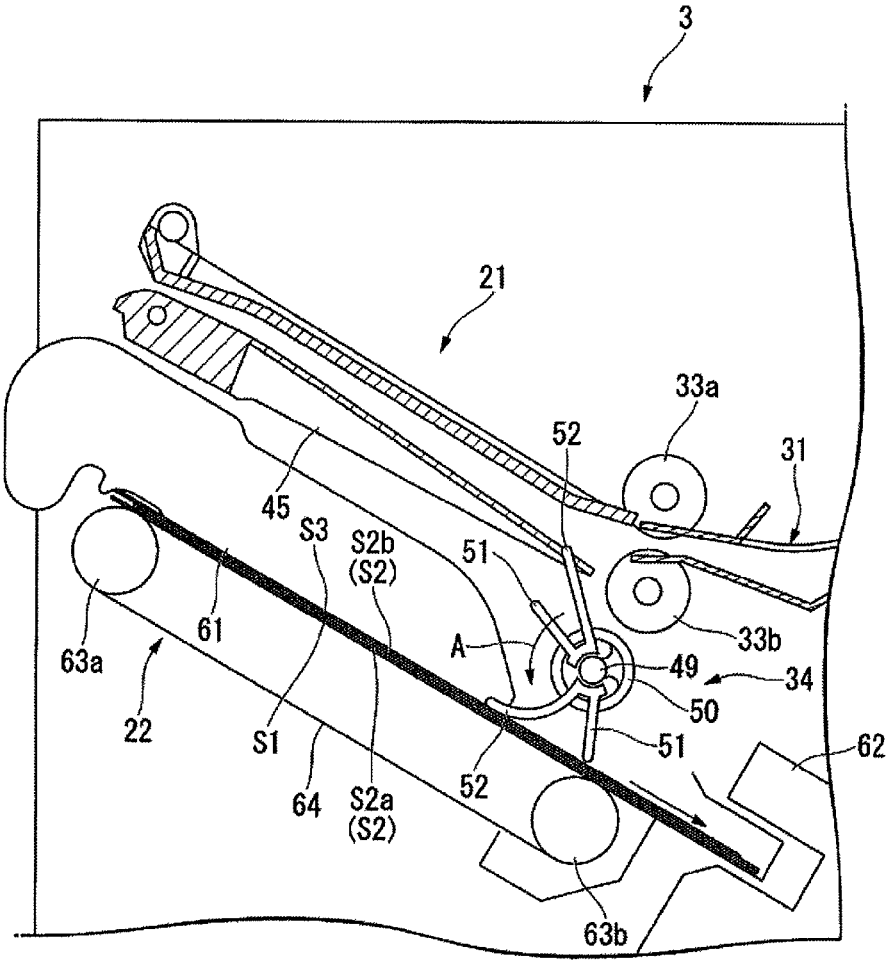
FIG. 12 is a cross-sectional view showing movements of sheets in a processing tray shown in FIG. 3.

FIG. 12 shows the first sheet S1, the second sheets S2*a* and S2*b*, and the third sheet S3 that have dropped on the processing tray 61. As shown in FIG. 12, in the processing tray 61, the third sheet S3 is sent toward the stapler 62 by the second paddles 52. Further, the first sheet S1 is sent toward the stapler 62 by the transport belt 64. As a result, the first sheet S1, the second sheets S2*a* and S2*b*, and the third sheet S3 are caused to abut on a rear end stopper (not shown) made of metal. The rear end stopper is provided to the depth of the stapler 62.

At that time, the second sheets S2*a* and S2*b* are displaced toward the stapler 62, as compared with the first sheet S1 and the third sheet S3. Thus, when the first sheet S1, the second sheets S2*a* and S2*b*, and the third sheet S3 are sent toward the stapler 62, the second sheets S2*a* and S2*b* first abut on the rear end stopper provided to the depth of the stapler 62. On the other hand, the first sheet S1 and the third sheet S3 are transported to a position abutting on the rear end stopper by the transport belt 64 and the second paddles 52. As a result, the first to third sheets S1, S2*a*, S2*b*, and S3 in the sheet transport direction D are aligned in position.

Figure 13:
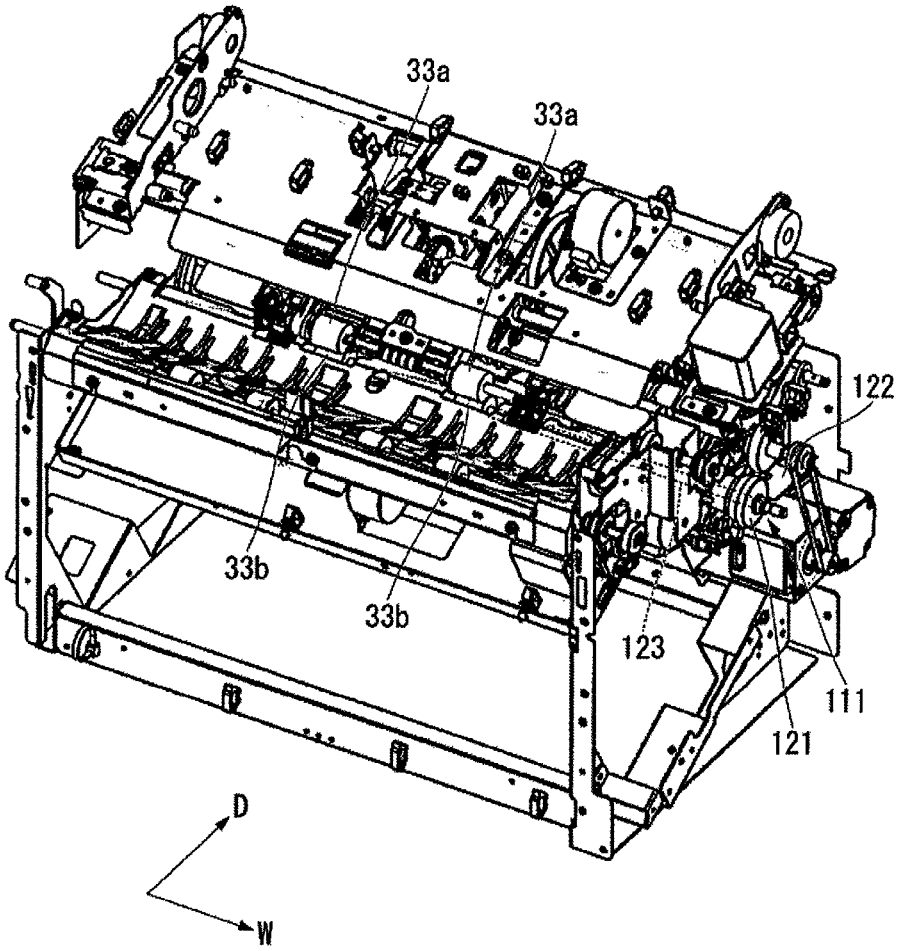
FIG. 13 is a perspective view showing the inside of the post-processing apparatus shown in FIG. 1.

Next, the rotation regulation unit 111 that fixes the rotation of the outlet roller 33*b* will be described. FIG. 13 shows a configuration of the rotation regulation unit 111.

For example, the rotation regulation unit 111 includes an electromagnetic clutch 121 and an electromagnetic clutch stopper 122. A turning shaft 123 is coupled to the outlet roller 33*b*. The turning shaft 123 rotates integrally with the outlet roller 33*b*. The electromagnetic clutch 121 is provided coaxially with the turning shaft 123. The electromagnetic clutch 121 switches between a holding state in which the rotation of the turning shaft 123 is regulated and a release state in which the rotation of the turning shaft 123 is permitted.

Figure 14:
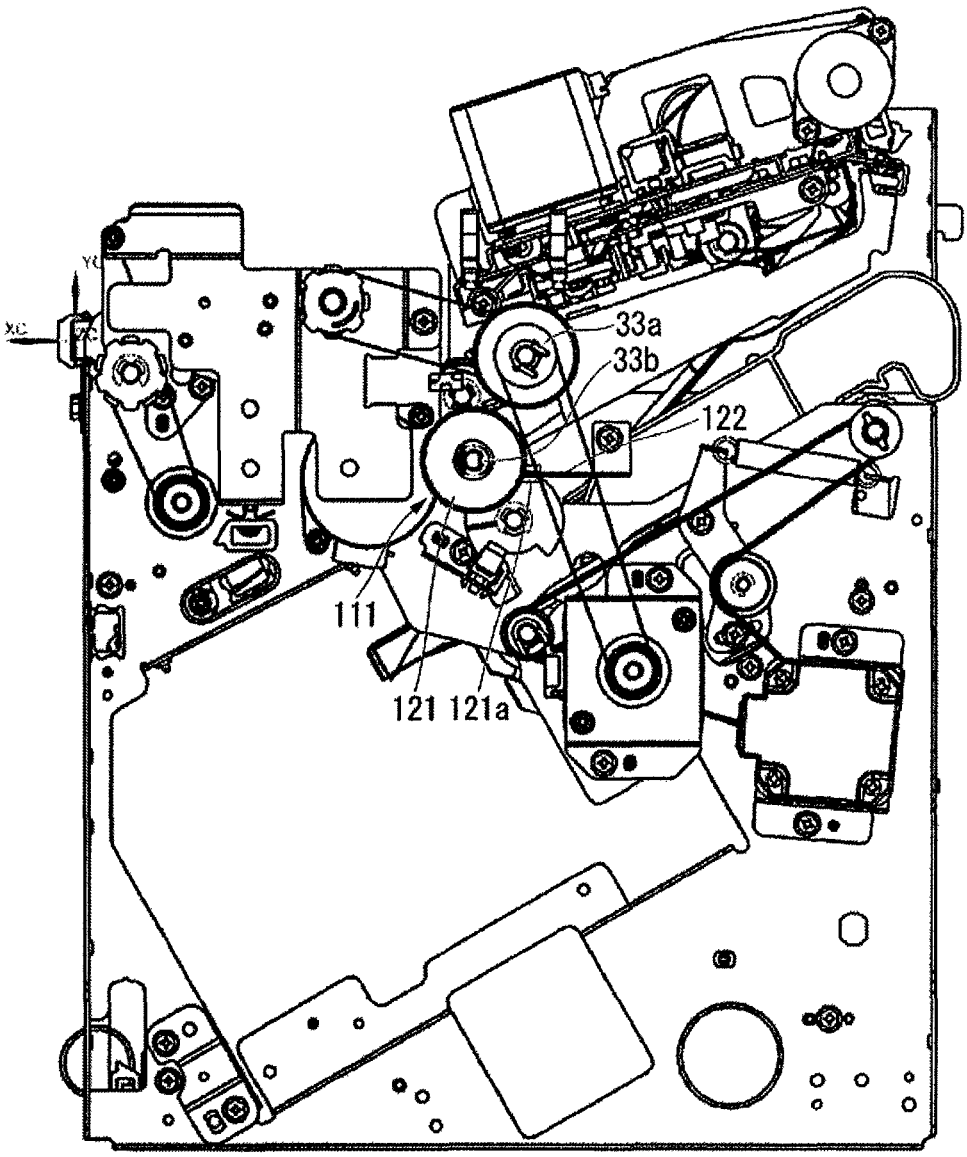
FIG. 14 is a front view showing the inside of the post-processing apparatus shown in FIG. 1.

FIG. 14 shows the rotation regulation unit 111 from a direction different from FIG. 13. The electromagnetic clutch stopper 122 faces the circumferential surface of the electromagnetic clutch 121. The circumferential surface of the electromagnetic clutch 121 is provided with an engagement portion 121*a* that is engaged with the electromagnetic clutch stopper 122. The engagement portion 121*a* is engaged with the electromagnetic clutch stopper 122. This prevents the electromagnetic clutch 121 from rotating with respect to the electromagnetic clutch stopper 122. In other words, the electromagnetic clutch 121 regulates the rotation of the turning shaft 123 and also regulates the rotation of the outlet roller 33*b* by the engagement portion 121*a* being engaged with the electromagnetic clutch stopper 122.

The outlet roller 33*b* functions as a driven roller that rotates in association with the rotation of the outlet turning roller 33*a* in a state where the rotation is permitted. On the other hand, the outlet roller 33*b* functions as a friction member (brake roller) that holds the sheets S in a state where the rotation is regulated.

Figure 15:
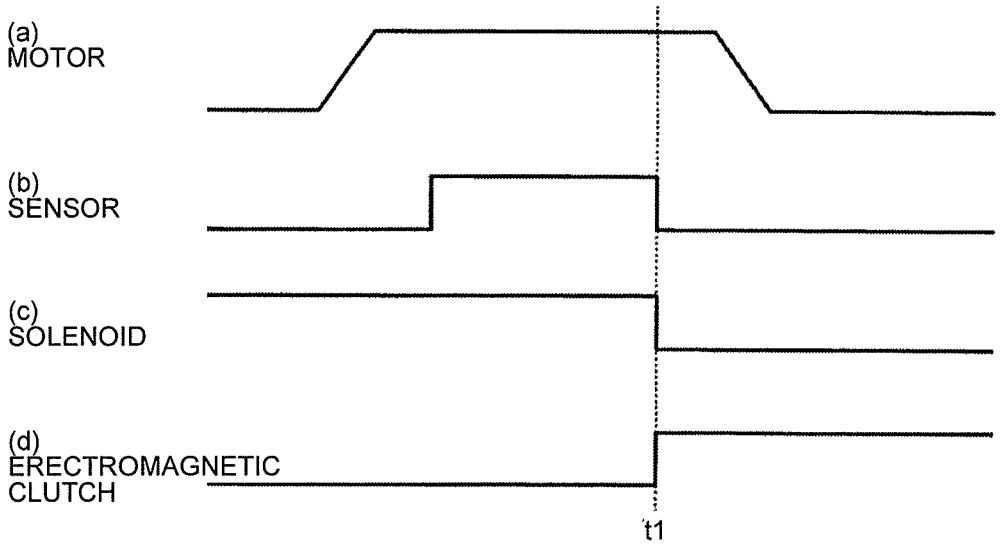
FIG. 15 is a view showing an operation example of an electromagnetic clutch shown in FIG. 13.

FIG. 15 shows an operation example of the electromagnetic clutch 121. It should be noted that, for convenience of description, in FIG. 15, a low output state is described as "OFF", and a high output state is described as "ON". A "motor" in part (a) of FIG. 15 indicates a drive state of a motor that drives the outlet turning roller 33*a*. A "sensor" in part (b) of FIG. 15 indicates a detection state of the sensor 112. In the part (b) of FIG. 15, "ON" of the output indicates a state where the sensor 112 is detecting the sheet S. On the other hand, "OFF" of the output indicates a state where the sensor 112 is not detecting the sheet S.

A "solenoid" in part (c) of FIG. 15 indicates an operating state of the turning device 110 that moves the outlet turning roller 33*a* between the transport position and the retraction position. In the part (c) of FIG. 15, "ON" of the output indicates that the outlet turning roller 33*a* is in the retraction position. On the other hand, "OFF" of the output indicates that the outlet turning roller 33*a* is in the transport position. An "electromagnetic clutch" in part (d) of FIG. 15 indicates an operating state of the electromagnetic clutch 121 with respect to the turning shaft 123. In the part (d) of FIG. 15, "ON" of the output indicates that the rotation of the outlet roller 33*b* is regulated (in the unrotatable state). On the other hand, "OFF" of the output indicates that the rotation of the outlet roller 33*b* is permitted (in the rotatable state).

FIG. 15 shows an operation performed in the case where the second sheet S2 is transported to the position under the outlet turning roller 33*a*, for example. As shown in FIG. 15, at a predetermined time t1, the sensor 112 detects that the second sheet S2 is transported to the position under the outlet turning roller 33*a*. The solenoid moves the outlet turning roller 33*a* downward to the transport position on the basis of a detection result of the sensor 112. As a result, the second sheet S2 can be transported by the outlet turning roller 33*a*. Further, the electromagnetic clutch 121 regulates the rotation of the outlet roller 33*b* on the basis of the detection result of the sensor 112. As a result, the first sheet S1 is held by the outlet roller 33*b*.

According to the post-processing apparatus 3 configured as described above, accuracy in alignment of the sheets S can be improved.

Here, in the case where the sheets S are aligned in the sheet transport direction D, the first sheet S1 (a sheet located at the lowermost position) can be transported to the processing unit 22 by the transport rollers 63*a* and 63*b* and the transport belt 64 of the processing tray 61 for the purpose of alignment processing. Further, the last sheet S3 (a sheet located at the uppermost position) can be transported to the processing unit 22 by the paddle unit 34 for the purpose of alignment processing. However, in the alignment processing for the intermediate sheet S2 sandwiched between the first sheet S1 and the last sheet S3, it may be impossible to directly transport the intermediate sheet S2 by the transport rollers 63*a* and 63*b*, the transport belt 64, and the paddle unit 34. For that reason, for example, in the case where the intermediate sheet S2 is displaced to the downstream side of the sheet transport direction D relative to the first sheet S1 and the last sheet S3, it is difficult to align those sheets S1, S2, and S3.

In this embodiment, the post-processing apparatus 3 includes the transport unit and the holding unit. The transport unit can transport the first sheet S1 to the first position. The transport unit includes the outlet turning roller 33*a* as an example. The transport unit can superimpose the second sheet S2, which is transported after the first sheet S1, on the first sheet S1 and also transport the second sheet S2 to the second position displaced to the upstream side of the sheet transport direction D relative to the first position. The transport unit can superimpose the third sheet S3, which is transported after the second sheet S2, on the second sheet S2 and also transport the third sheet S3 to the third position displaced to the downstream side of the sheet transport direction D relative to the second position. The holding unit includes as an example the presser member 91 and the friction member. Additionally, the friction member includes as an example the outlet roller 33*b* and the rotation regulation unit 111. In the case where the transport unit transports the second sheet S2 to the second position, the holding unit holds the first sheet S1 at the first position. In the case where the transport unit transports the third sheet S3 to the third position, the holding unit holds the second sheet S2 at the second position.

According to the configuration described above, the transport unit and the holding unit create a state where the second sheet S2 is previously displaced to the upstream side of the sheet transport direction D relative to the first sheet S1 and the third sheet S3. In the case where the second sheet S2 is displaced to the upstream side of the sheet transport direction D relative to the first sheet S1 and the third sheet S3, the second sheet S2 is pressed against the depth of the stapler 62, so that the first and third sheets S1 and S3 and the second sheet S2 can be easily aligned in position. As a result, accuracy in alignment of the sheets S can be improved. For example, even in the case where four or more sheets S are superimposed to be kept waiting in the standby tray 41, multiple intermediate sheets S2 and the first and last sheets S1 and S3 can be easily aligned.

In this embodiment, the holding unit includes the presser member 91. The presser member 91 is openable and closable with respect to the sheet transport surface (the upper surface 75*a* of the first guide member 75) on which the sheets S are transported. The presser member 91 can press the first sheet S1 located at the first position and the second sheet S2 located at the second position toward the sheet transport surface. According to such a configuration, the presser member 91 and the sheet transport surface sandwich the first sheet S1 and the second sheet S2, and thus the positions of the first sheet S1 and the second sheet S2 can be reliably held.

In this embodiment, the presser member 91 can press the first sheet S1 and the second sheet S2 toward the sheet transport surface (the upper surface 75*a* of the first guide member 75) in a state where the second sheet S2 is superimposed on the first sheet S1. According to such a configuration, the first sheet S1 and the second sheets S2 in a mutually overlapping manner can be held relatively tightly.

In this embodiment, the transport unit transports the first sheet S1 in the opposite direction to the sheet transport direction D in a state where the presser member 91 is separated from the sheet transport surface (the upper surface 75*a* of the first guide member 75), and thus can insert the first sheet S1 between the sheet transport surface and the presser member 91. According to such a configuration, the first sheet S1 can be reliably inserted between the sheet transport surface and the presser member 91.

In this embodiment, the holding unit includes the outlet roller 33*b* capable of holding the first sheet S1, apart from the presser member 91. The first sheet S1 is held at the first position by the outlet roller 33*b* as the presser member 91 separates from the sheet transport surface. The transport unit transports the second sheet S2 in the opposite direction to the sheet transport direction D in a state where the first sheet S1 is held at the first position, and thus can insert the second sheet S2 between the sheet transport surface (the upper surface 75*a* of the first guide member 75) and the presser member 91. According to such a configuration, the outlet roller 33*b* as a friction member is provided apart from the presser member 91, and thus the position of the first sheet S1 can be held even in a state where the presser member 91 moves to the opened position. As a result, it is possible to reliably insert the second sheet S2 between the sheet transport surface and the presser member 91 while holding the position of the first sheet S1.

In this embodiment, the post-processing apparatus 3 includes the standby tray 41. In the standby tray 41, the first sheet S1, the second sheet S2, and the third sheet S3 can wait in a mutually overlapping manner. In a state where the first sheet S1 is located at the first position, a part of the first sheet S1 remains on the upstream side of the transport path 31 relative to the standby tray 41. In a state where the second sheet S2 is located at the second position, a part of the second sheet S2 remains in the transport path 31. The presser member 91 is provided to the transport path 31. The presser member 91 holds the first sheet S1 and the second sheet S2 within the transport path 31. According to such a configuration, the standby tray 41 can be downsized. As a result, it is possible to achieve downsizing of the post-processing apparatus 3. Further, a space in a sheet thickness direction within the transport path 31 is smaller than a space in the sheet thickness direction within the standby unit 21. Thus, even in the case where the sheets S have curls and the like, curves of the sheets S are relatively reduced within the transport path 31. Thus, if the presser member 91 is provided to the transport path 31, for example, as compared to a case where the presser member 91 is provided to the standby unit 21, the rear end of the sheets S is easy to press. In other words, according to the configuration described above, the rear end of the sheets S can be stably held.

In this embodiment, the presser member 91 is movable between the opened position and the closed position. In the opened position, the presser member 91 closes the transport path 31. Further, in the opened position, the first sheet S1 and the second sheet S2 can be inserted between the sheet transport surface and the presser member 91. In the closed position, the presser member 91 opens the transport path 31. Further, in the closed position, the first sheet S1 and the second sheet S2 are sandwiched between the sheet transport surface and the presser member 91. According to such a configuration, in the case where the presser member 91 is in the opened position, the sheets S transported in the opposite direction to the sheet transport direction D are not conversely transported beyond the presser member 91. Thus, the sheets S transported in the opposite direction to the sheet transport direction D are reliably inserted between the presser member 91 and the sheet transport surface.

In this embodiment, a part of the third sheet S3 remains in the transport path 31 in a state where the third sheet S3 is located at the third position. In the case where the third sheet S3 is transported to the third position, the presser member 91 is movable to the release position. In the release position, the third sheet S3 is permitted to move in the transport path 31, and the holding state of the first sheet S1 and the second sheet S2 is released. According to such a configuration, the transport of the third sheet S3 in the transport path 31 is permitted, and the first sheet S1 and the second sheet S2 can be transported together with the third sheet S3. As a result, the first sheet S1, the second sheet S2, and the third sheet S3 can be transported to the downstream side (toward the standby tray 41) in the overlapping manner.

In this embodiment, the friction member includes the outlet roller 33*b* and the rotation regulation unit 111. The outlet roller 33*b* includes the friction member 106 in at least the circumferential surface. The rotation regulation unit 111 can regulate the rotation of the outlet roller 33*b*. According to such a configuration, one outlet roller 33*b* can be provided with both a function of a driven roller used to transport the sheets S and a function of a friction member to hold the position of the sheet S. As a result, it is possible to reduce the number of components of the post-processing apparatus 3. This contributes to the downsizing of the post-processing apparatus 3.

The rotation regulation unit 111 includes the electromagnetic clutch 121 that can regulate the rotation of the outlet roller 33*b*. The electromagnetic clutch 121 is less expensive than a motor. Thus, according to the configuration described above, as compared with a case where a rotation state of the outlet roller 33*b* is switched by a motor, reduction of cost of the post-processing apparatus 3 can be achieved. Further, the electromagnetic clutch 121 has a holding force (rotation regulation force) stronger than the motor. Thus, according to the configuration described above, as compared with a case where a stop state of the outlet roller 33*b* is achieved by the motor, a brake force of the outlet roller 33*b* can be enhanced. As a result, the sheets S can be stably held by the outlet roller 33*b*. It should be noted that the rotation regulation unit 111 is not limited to the electromagnetic clutch 121. The rotation regulation unit 111 may be achieved by a one-way clutch, for example.

Further, the configurations according to the embodiment are not limited to the above examples. For example, the sheet processing apparatus may be an image-forming apparatus including an inner finisher within a casing.

According to at least one embodiment described above, the post-processing apparatus 3 includes the transport unit and the holding unit. The transport unit can transport the first sheet S1 to the first position. The transport unit can superimpose the second sheet S2, which is transported after the first sheet S1, on the first sheet S1 and also transport the second sheet S2 to the second position displaced to the upstream side of the sheet transport direction D relative to the first position. The transport unit can superimpose the third sheet S3, which is transported after the second sheet S2, on the second sheet S2 and also transport the third sheet S3 to the third position displaced to the downstream side of the sheet transport direction D relative to the second position. In the case where the transport unit transports the second sheet S2 to the second position, the holding unit holds the first sheet S1 at the first position. In the case where the transport unit transports the third sheet S3 to the third position, the holding unit holds the second sheet S2 at the second position. As a result, accuracy in alignment of the sheets S can be improved.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet processing apparatus, comprising:

a transport unit that is controlled to transport a first sheet to a first position, transport a second sheet to a second position, which is displaced to an upstream side of a sheet transport direction relative to the first position, after the second sheet has been superimposed on the first sheet, and transport a third sheet to a third position, which is displaced to a downstream side of the sheet transport direction relative to the second position, after the third sheet has been superimposed on the second sheet;

a holding unit that is controlled to hold the first sheet at the first position when the transport unit transports the second sheet to the second position, and hold the second sheet at the second position when the transport unit transports the third sheet to the third position; and a sheet transport guide that guides the first, second, and third sheets towards the transport unit and the holding unit, the sheet transport guide including a sheet supporting surface, wherein the holding unit includes a presser member that is openable and closable with respect to the sheet supporting surface, an outlet roller near an outlet portion of the sheet transport guide and having a friction member in at least a circumferential surface thereof, and a rotation regulation unit that regulates rotation of the outlet roller to make the outlet roller unrotatable, wherein the presser member is closed to press any sheets on the sheet supporting surface against the sheet supporting surface, and is opened by moving away from the sheet supporting surface, wherein, to transport the first sheet to the first position, the transport unit transports the first sheet in an opposite direction to the sheet transport direction while the presser member is opened, to insert the first sheet between the sheet supporting surface and the presser member, and wherein, to transport the second sheet to the second position, the transport unit transports the second sheet in the opposite direction to the sheet transport direction while the presser member is opened and the rotation regulation unit makes the outlet roller unrotatable, to insert the second sheet between the sheet supporting surface and the presser member and hold the first sheet in place at the first position against the friction member.

2. The sheet processing apparatus according to claim 1, wherein after transporting the second sheet to the second position, the presser member presses the first sheet and the second sheet toward the sheet supporting surface while the second sheet is superimposed on the first sheet.

3. The sheet processing apparatus according to claim 1, further comprising a standby tray that holds the first sheet, the second sheet, and the third sheet in a mutually overlapping manner, wherein the sheet transport guide is located on an upstream side of the standby tray, a part of the first sheet remains in the sheet transport guide in a state where the first sheet is located at the first position, a part of the second sheet remains in the sheet transport guide in a state where the second sheet is located at the second position, and the presser member holds parts of the first sheet and the second sheet within the sheet transport guide.

4. The sheet processing apparatus according to claim 3, wherein the sheet transport guide has a sheet holding space that is narrower than a sheet holding space of the standby tray in a sheet thickness direction.

5. The sheet processing apparatus according to claim 3, wherein the presser member is movable between an open position in which the presser member closes a sheet transport path along which the sheet transport guide guides the first, second, and third sheets towards the transport unit and the holding unit, and the first sheet and the second sheet can be inserted between the sheet supporting surface and the presser member, and a closed position in which the presser member opens the sheet transport path and the first sheet and the second sheet, when inserted between the sheet supporting surface and the presser member, are sandwiched between the sheet supporting surface and the presser member.

6. The sheet processing apparatus according to claim 5, wherein a part of the third sheet remains in the sheet transport path in a state where the third sheet is located at the third position, and after the third sheet is transported to the third position, the presser member is moved to an open position in which holding of the first sheet and the second sheet is released.

7. The sheet processing apparatus according to claim 1, wherein the presser member is provided within the sheet transport guide.

8. The sheet processing apparatus according to claim 1, wherein the rotation regulation unit includes an electromagnetic clutch that makes the outlet roller unrotatable.

* * * * *